US011015283B2

(12) United States Patent
Park et al.

(10) Patent No.: US 11,015,283 B2
(45) Date of Patent: May 25, 2021

(54) CLOTHES MANAGER AND CONTROL METHOD THEREOF

(71) Applicant: Samsung Electronics Co., Ltd., Suwon-si (KR)

(72) Inventors: Eunyoung Park, Suwon-si (KR); Dongil Back, Suwon-si (KR); Dongyun Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/567,502

(22) Filed: Sep. 11, 2019

(65) Prior Publication Data

US 2020/0087846 A1 Mar. 19, 2020

(30) Foreign Application Priority Data

Sep. 13, 2018 (KR) ..... 10-2018-0109417

(51) Int. Cl.

| | |
|---|---|
| ***D06F 58/30*** | (2020.01) |
| ***D06F 58/10*** | (2006.01) |
| ***G08B 21/02*** | (2006.01) |
| ***D06F 34/28*** | (2020.01) |
| ***D06F 101/00*** | (2020.01) |
| ***D06F 103/00*** | (2020.01) |
| ***D06F 103/02*** | (2020.01) |
| ***D06F 105/58*** | (2020.01) |

(52) U.S. Cl.

CPC ..... *D06F 58/30* (2020.02); *D06F 58/10* (2013.01); *G08B 21/02* (2013.01); *D06F 34/28* (2020.02); *D06F 2101/00* (2020.02); *D06F 2103/00* (2020.02); *D06F 2103/02* (2020.02); *D06F 2105/58* (2020.02)

(58) Field of Classification Search

None

See application file for complete search history.

(56) References Cited

U.S. PATENT DOCUMENTS 7,106,207 B1 * 9/2006 Marchan ..... B60N 2/002 340/438
9,109,319 B2 8/2015 Astrauskas
(Continued)

FOREIGN PATENT DOCUMENTS

JP 2013-124798 A 6/2013
JP 2015-022906 A 2/2015
(Continued)

OTHER PUBLICATIONS

International Search Report dated Dec. 20, 2019, issued in International Application No. PCT/KR2019/011881.

*Primary Examiner* — Fekadeselassie Girma
(74) *Attorney, Agent, or Firm* — Jefferson IP Law, LLP

(57) ABSTRACT

A clothes manager is provided. The clothes manager includes a cabinet including an accommodation space in which clothes are accommodated, a door provided to open and close an opening of the cabinet, a clothes treating device provided to treat the clothes accommodated in the accommodation space of the cabinet, a sensing device configured to detect that a human or an animal enters the cabinet, and a processor configured to output an abnormal detection signal based on a human or animal detection signal transmitted by the sensing device.

21 Claims, 16 Drawing Sheets

(56) References Cited

U.S. PATENT DOCUMENTS

| | | | | |
|---|---|---|---|---|
| 10,145,059 | B2 | 12/2018 | Kim | |
| 2007/0241613 | A1* | 10/2007 | Koski | H01H 35/343 307/10.1 |
| 2012/0235514 | A1* | 9/2012 | Astrauskas | D06F 33/00 307/326 |
| 2014/0251234 | A1* | 9/2014 | Deutsch | A01K 15/021 119/721 |
| 2015/0168205 | A1* | 6/2015 | Lee | H04M 1/0254 177/1 |
| 2017/0169679 | A1* | 6/2017 | Johnson | E05B 47/0012 |
| 2017/0268924 | A1* | 9/2017 | Shin | G01H 11/00 |
| 2017/0350066 | A1* | 12/2017 | Kim | D06F 73/02 |
| 2017/0364049 | A1* | 12/2017 | Yang | D06F 75/26 |
| 2018/0022471 | A1* | 1/2018 | Sarai | B64C 1/14 70/91 |
| 2019/0330784 | A1* | 10/2019 | Wheeler | G01G 19/52 |
| 2020/0080256 | A1* | 3/2020 | Bensel | D06F 75/08 |
| 2020/0122311 | A1* | 4/2020 | Tsuruta | H01H 13/66 |

FOREIGN PATENT DOCUMENTS

| | | | | |
|---|---|---|---|---|
| JP | 2017-006499 | A | 1/2017 | |
| KR | 1999-0016316 | U | 5/1999 | |
| KR | 10-2010-0054341 | A | 5/2010 | |
| KR | 10-1019668 | B1 | 3/2011 | |
| KR | 10-2016-0009402 | A | 1/2016 | |
| KR | 10-2017-0137503 | A | 12/2017 | |
| WO | WO-2011025101 | A1 * | 3/2011 | D06F 34/18 |

* cited by examiner

CLOTHES MANAGER AND CONTROL METHOD THEREOF

CROSS-REFERENCE TO RELATED APPLICATION(S)

This application is based on and claims priority under 35 U.S.C. § 119(a) of a Korean Patent Application number 10-2018-0109417, filed on Sep. 13, 2018, in the Korean Intellectual Property Office, the disclosure of which is incorporated by reference herein in its entirety.

BACKGROUND

1. Field

The disclosure relates to a clothes manager. More particularly, the disclosure relates to a clothes manager having a child protection function and a control method thereof.

2. Description of the Related Art

Recently, a clothes manager for treating or regenerating clothes is widely used to remove wrinkles of clothes or to remove odors such as cigarette smells or food smells from the clothes.

In general, the clothes manager has a cabinet including an accommodation space for storing clothes.

A child may open a door of the cabinet and enter the accommodation space. After a certain time has elapsed when the child enters the cabinet and closes the door, the child may asphyxiate and die.

However, the clothes managers do not have a function to detect and notify that the child has entered the accommodation space of the cabinet of the related art. Only a manual or warning signs, such as labels and the like, are used to prevent children from entering the cabinet. Therefore, the clothes managers have a problem that they cannot prevent asphyxiation of children in the related art.

The above information is presented as background information only to assist with an understanding of the disclosure. No determination has been made, and no assertion is made, as to whether any of the above might be applicable as prior art with regard to the disclosure.

SUMMARY

The disclosure has been developed in order to overcome the above drawbacks and other problems associated with the arrangement of the related art.

Aspects of the disclosure are to address at least the above-mentioned problems and/or disadvantages and to provide at least the advantages described below. Accordingly, an aspect of the disclosure relates to a clothes manager having a child protection function that can detect and notify a user when a child has entered the clothes manager.

Another aspect of the disclosure is to provide a clothes manager having a child protection function that can detect that a child has entered the clothes manager, stop an operation of the clothes manager, and open an exhaust device to prevent asphyxiation of the child.

Additional aspects will be set forth in part in the description which follows and, in part, will be apparent from the description, or may be learned by practice of the presented embodiments.

In accordance with an aspect of the disclosure, a clothes manager is provided. The clothes manager includes a cabinet including an accommodation space in which clothes are accommodated, a door provided to open and close an opening of the cabinet, a clothes treating device provided to treat the clothes accommodated in the accommodation space of the cabinet, a sensing device configured to detect that a human or an animal enters the cabinet, and a processor configured to output an abnormal detection signal based on the human or the animal detection signal being transmitted by the sensing device.

The sensing device may include an intermediate plate forming a bottom of the accommodation space of the cabinet, and a tact switch disposed below the intermediate plate and configured to transmit a signal to the processor when the intermediate plate is in contact with the tact switch.

The tact switch is configured to swing at a predetermined angle.

The sensing device may include a fixed bracket fixed to a case of the clothes treating device, a support rotatably disposed in the fixed bracket and configured to support the tact switch, and an elastic member provided to elastically support the support.

The cabinet may include an exhaust device. When the human or animal detection signal is received from the sensing device, the processor may operate the exhaust device to open the accommodation space of the cabinet to an outside environment.

The exhaust device may include a first exhaust device provided in the door and a second exhaust device provided in an upper portion of the cabinet.

The sensing device may be disposed inside the cabinet and may include any one of an image sensor, a carbon dioxide sensor, a motion detection sensor, or a temperature sensor configured to identify a human or an animal.

The sensing device may include an intermediate plate forming a bottom of the accommodation space, and a displacement detection sensor configured to detect a displacement of the intermediate plate.

The sensing device may be disposed in a lower portion of the clothes manager and may include a load cell configured to detect a weight change of the clothes manager.

The sensing device may include a door sensor configured to output a signal when the door is opened, and when the signal is received from the door sensor while the clothes treating device is in operation, the processor may stop the operation of the clothes treating device and output an abnormal detection signal.

The clothes manager may be configured to transmit the abnormal detection signal output from the processor to a mobile device.

The clothes manager may include a control panel configured to receive a user command, the control panel may include an operation button configured to turn on or off the sensing device.

In accordance with another aspect of the disclosure, a control method of a clothes manager including a cabinet, a clothes treating device, a sensing device, and a processor is provided. The control method includes pressing an operation button of the sensing device to operate the sensing device, generating an abnormal detection alarm based on an abnormal detection signal output by the processor based on a human or animal detection signal being received from the sensing device, and stopping an operation of the sensing device and releasing the abnormal detection alarm when the operation button is pressed again or when the power button is pressed.

The sensing device may be configured to operate when the clothes manager is turned off.

When the human or animal detection signal is received from the sensing device while the clothes manager is in operation, the processor may stop an operation of the clothes manager.

When a door of the clothes manager is opened and closed while the clothes manager is in operation, the processor may stop an operation of the clothes manager.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features and advantages of certain embodiments of the disclosure will be more apparent from the following description taken in conjunction with the accompanying drawings of which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

The matters defined herein, such as a detailed construction and elements thereof, are provided to assist in a comprehensive understanding of this description. Thus, it is apparent that embodiments may be carried out without those defined matters. Also, well-known functions or constructions are omitted to provide a clear and concise description of embodiments. Further, dimensions of various elements in the accompanying drawings may be arbitrarily increased or decreased for assisting in a comprehensive understanding.

The terms 'first', 'second', etc. may be used to describe diverse components, but the components are not limited by the terms. The terms may only be used to distinguish one component from the others. For example, without departing from the scope of the disclosure, a first component may be referred to as a second component, and similarly, a second component may also be referred to as a first component.

The terms used in embodiments of the disclosure may be construed as commonly known to those skilled in the art unless otherwise defined.

Further, the terms 'leading end', 'rear end', 'upper side', 'lower side', 'top end', 'bottom end', etc. used in the disclosure are defined with reference to the drawings. However, the shape and position of each component are not limited by the terms.

In the following description, a child may be used to mean not only a child but also a human or an animal that may enter a clothes manager.

Figure 1:
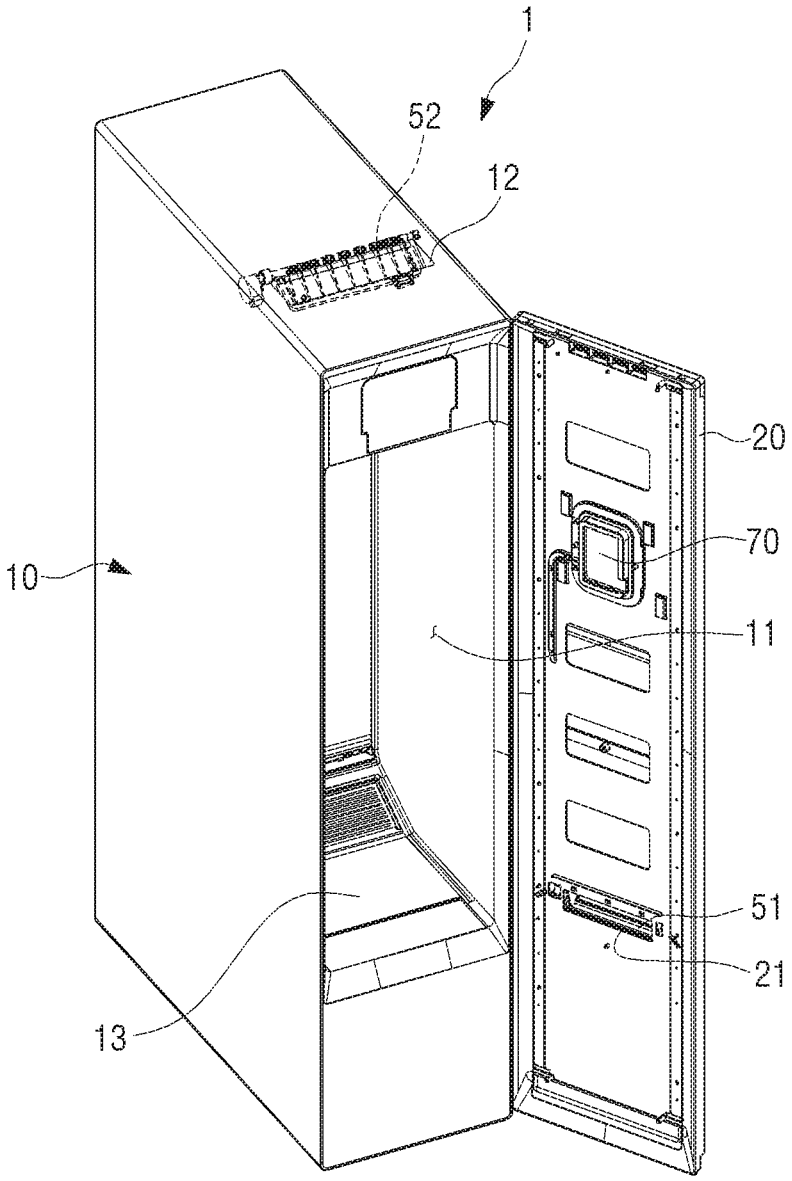
FIG. 1 is a perspective view illustrating a clothes manager according to an embodiment of the disclosure.

FIG. 1 is a perspective view illustrating a clothes manager according to an embodiment of the disclosure.

Figure 2:
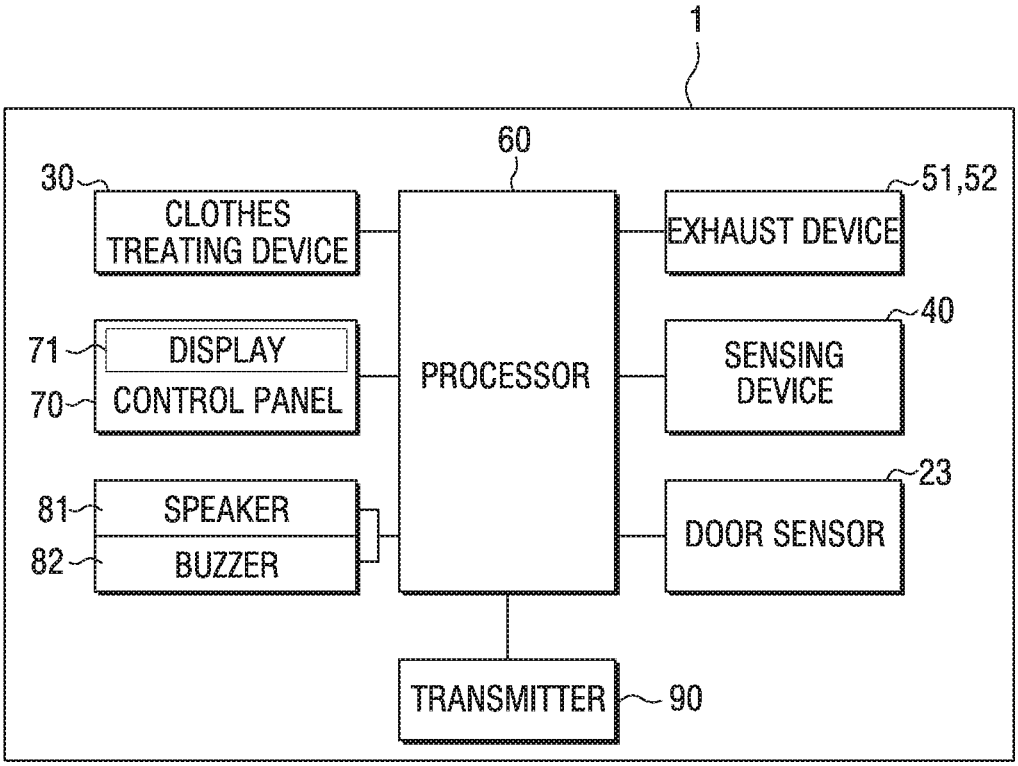
FIG. 2 is a functional block diagram of a clothes manager according to an embodiment of the disclosure.

FIG. 2 is a functional block diagram of a clothes manager according to an embodiment of the disclosure.

Referring to FIGS. 1 and 2, a clothes manager 1 according to an embodiment of the disclosure may include a cabinet 10, a clothes treating device 30, a sensing device 40, and a processor 60.

The cabinet 10 forms the appearance of the clothes manager 1 and may be formed in a substantially rectangular parallelepiped shape. An interior of the cabinet 10 is provided with an accommodation space 11 in which clothes may be accommodated. An opening for putting clothes in and out is provided in the front surface of the cabinet 10. The front surface of the cabinet 10 is provided with a door 20 to allow or prevent access to the accommodation space. The door 20 is rotatably disposed with respect to the cabinet 10. When the door 20 is closed, the accommodation space 11 of the cabinet 10 is sealed.

The cabinet 10 may be partitioned into two spaces by an intermediate plate 13. The upper space above the intermediate plate 13 forms the accommodation space 11 in which clothes may be stored, and the clothes treating device 30 is disposed in the lower space.

The intermediate plate 13 is formed of plastic so that a depression occurs when an object is placed on the intermediate plate 13 or when a human or an animal climbs up the intermediate plate 13. For example, when an object having a weight of about 5 Kg (for example, a blanket) is placed on the intermediate plate 13, the intermediate plate 13 is depressed to about 2 mm or less. When an object having a weight of 10-20 Kg, which is usually a child's weight, is placed on the intermediate plate 13, the intermediate plate 13 is depressed to about 3-5 mm. In other words, the intermediate plate 13 may be formed to be deformed approximately linearly depending on the weight of the object placed on the intermediate plate 13.

The clothes treating device 30 is provided to refresh clothes accommodated in the accommodation space 11 of the cabinet 10. In detail, the clothes treating device 30 may be formed to remove contaminants attached to the clothes, to remove dust adsorbed on the clothes, or to unfold wrinkles formed on the clothes. The clothes treating device 30 may be the same as or similar to the clothes treating device of the clothes manager; therefore, a detailed description thereof is omitted of the related art.

The sensing device 40 is provided to detect whether a human or an animal (mainly child) enters the accommodation space 11 of the cabinet 10. When a human or an animal enters the accommodation space 11 of cabinet 10, the sensing device 40 detects this and outputs a human or animal detection signal to the processor 60. Therefore, the sensing device 40 may be referred to as a child sensing device.

The sensing device 40 may be configured in various ways as long as it can detect a human or an animal that has entered the accommodation space 11 of the cabinet 10. Hereinafter, the case where a child enters the accommodation space 11 of the cabinet 10 will be described as an example.

When a child enters the cabinet 10, the intermediate plate 13 is depressed downward due to the weight of the child, so that the sensing device 40 may be configured to identify whether the child has entered the cabinet 10 by detecting the depressing of the intermediate plate 13.

The clothes manager further includes exhaust ports 12 and 21, a door sensor 23, exhaust devices 51 and 52, a control panel 70 with a display 71, a speaker 81 or a buzzer 82, and a transmitter 90.

Hereinafter, the sensing device 40 configured to detect the depressing of the intermediate plate 13 will be described in detail with reference to FIGS. 3 to 7.

Figure 3:
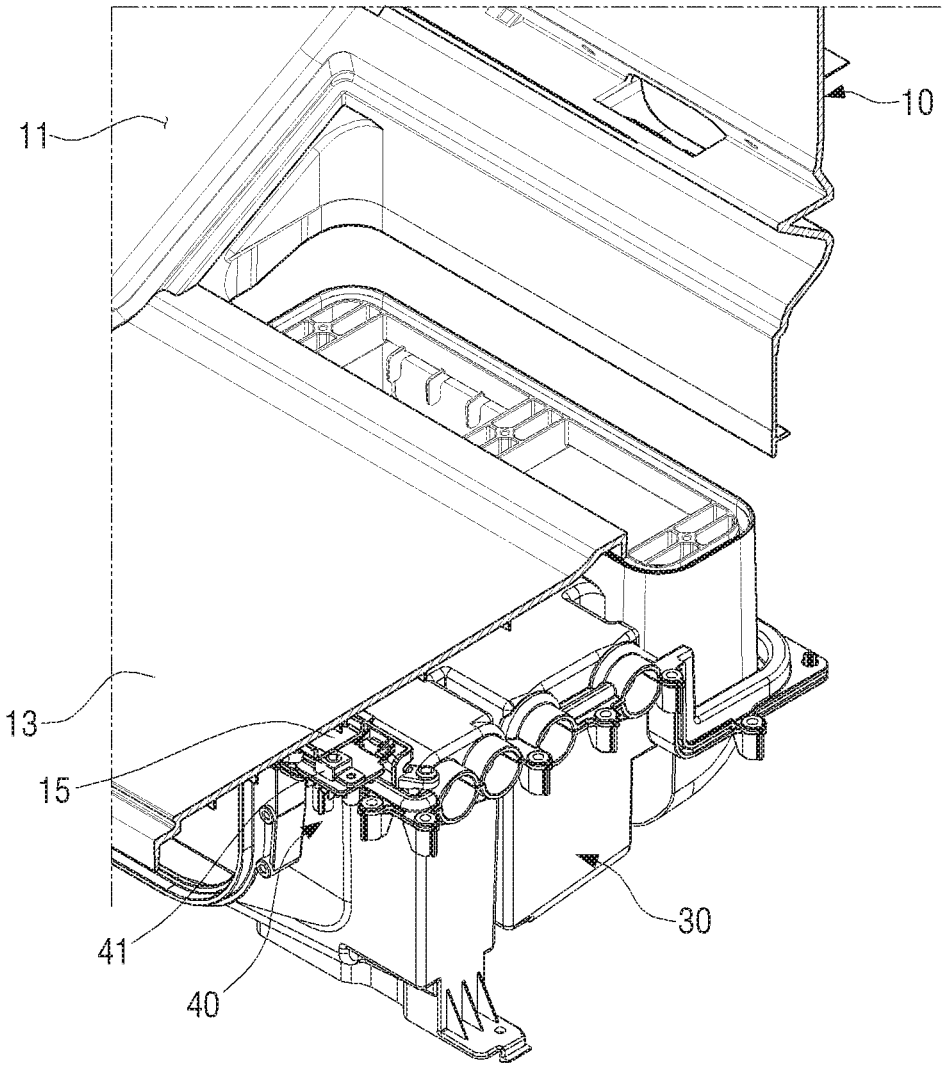
FIG. 3 is a partial sectional perspective view illustrating an intermediate plate and a sensing device of a clothes manager according to an embodiment of the disclosure.

FIG. 3 is a partial sectional perspective view illustrating an intermediate plate and a sensing device of a clothes manager according to an embodiment of the disclosure.

Figure 4:
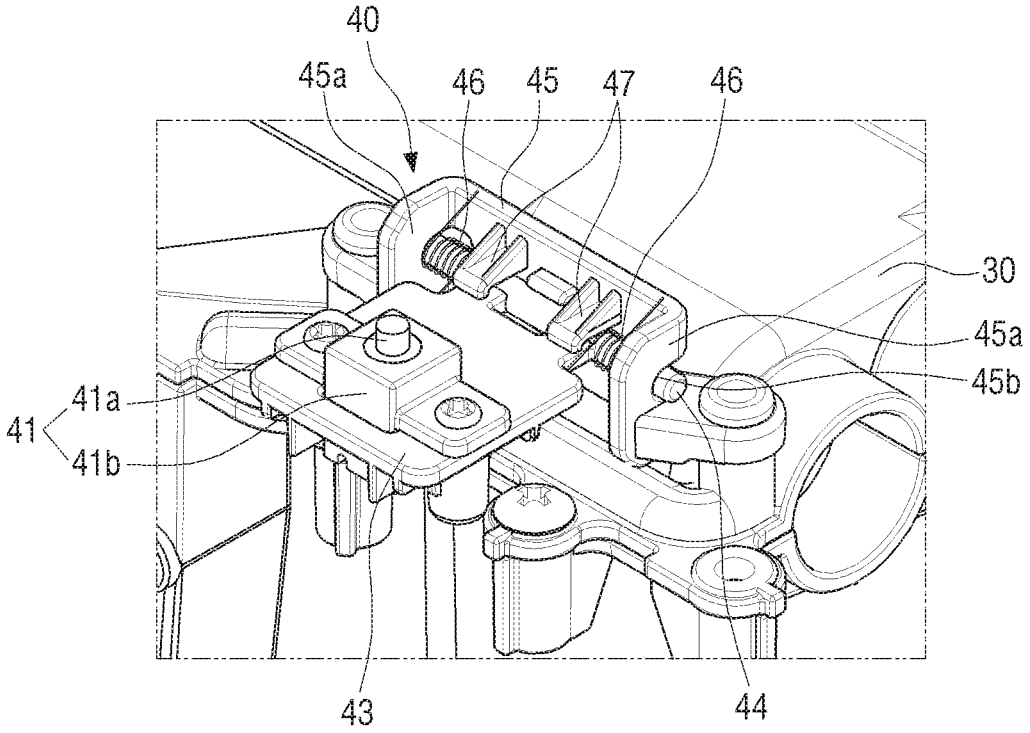
FIG. 4 is a perspective view illustrating an example of a sensing device used in a clothes manager according to an embodiment of the disclosure.

FIG. 4 is a perspective view illustrating an example of a sensing device used in a clothes manager according to an embodiment of the disclosure.

Figure 5:
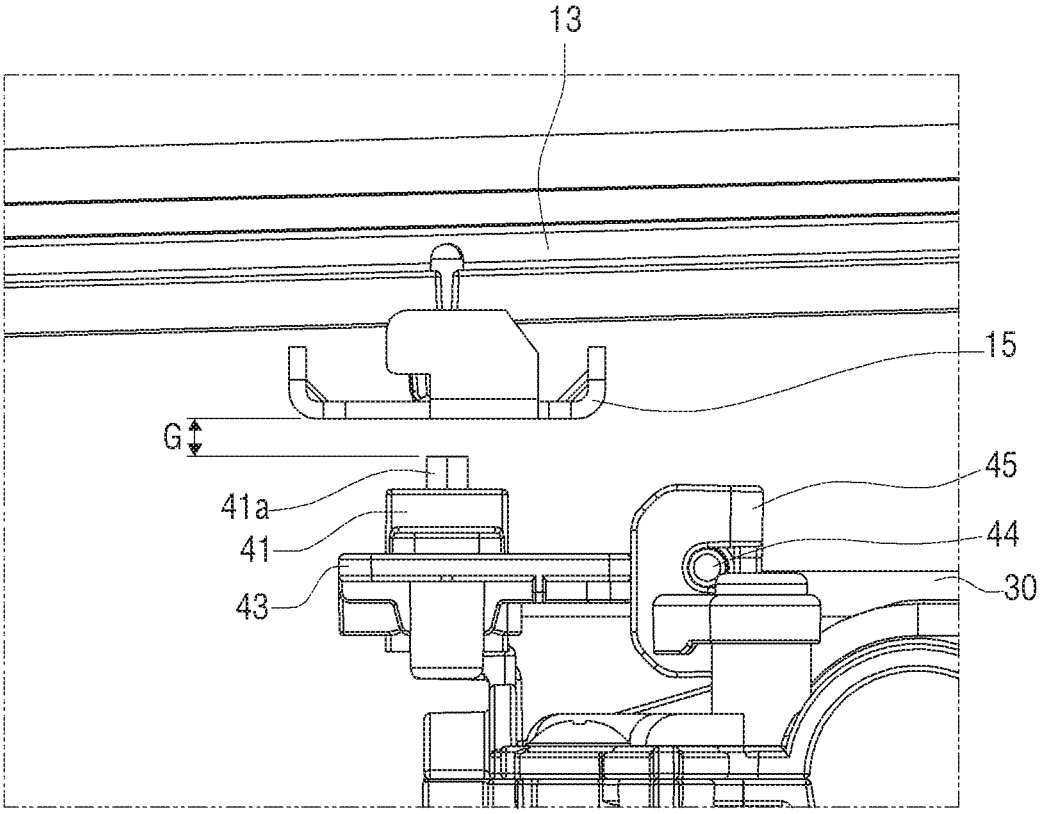
FIG. 5 is a side view of the sensing device of FIG. 4 according to an embodiment of the disclosure.

FIG. 5 is a side view of the sensing device of FIG. 4 according to an embodiment of the disclosure.

Figure 6:
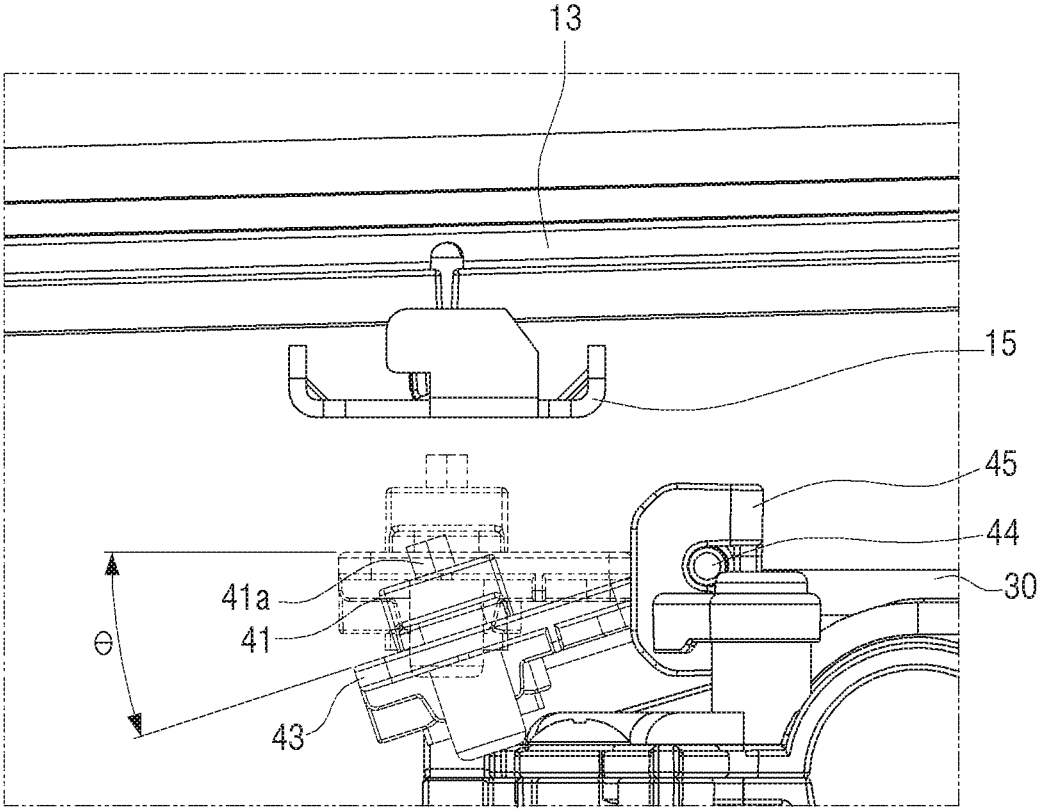
FIG. 6 is a side view illustrating a state in which the sensing device of FIG. 4 is rotated to a maximum amount according to an embodiment of the disclosure.

FIG. 6 is a side view illustrating a state in which the sensing device of FIG. 4 is rotated to a maximum amount according to an embodiment of the disclosure.

Figure 7:
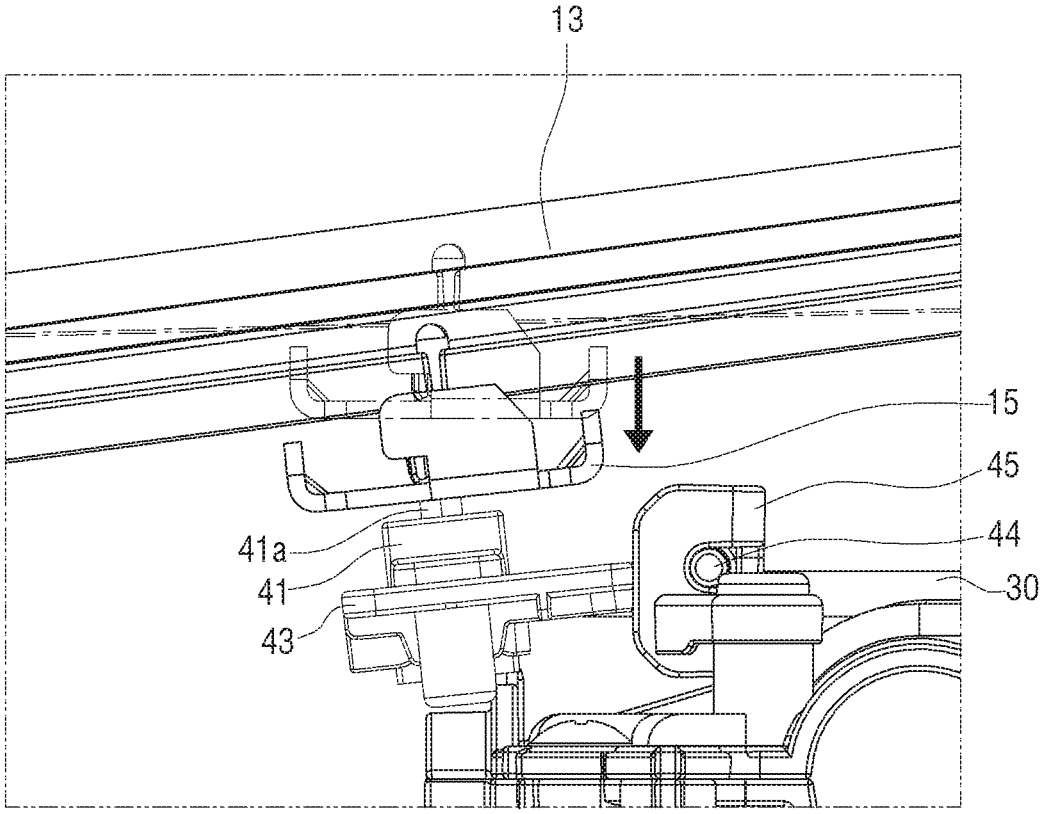
FIG. 7 is a side view illustrating a state in which a tact switch of the sensing device of FIG. 4 is pressed according to an embodiment of the disclosure.

FIG. 7 is a side view illustrating a state in which a tact switch of the sensing device of FIG. 4 is pressed according to an embodiment of the disclosure.

Referring to FIG. 3, the sensing device 40 is disposed below the intermediate plate 13 so as to detect the depressing of the intermediate plate 13.

Referring to FIGS. 4 and 5, the sensing device 40 may include a tact switch 41 and a pressing member 15.

The tact switch 41 is provided to detect the depressing of the intermediate plate 13. The tact switch 41 includes a knob 41*a* which is movable up and down and a switch body 41*b* formed to guide the movement of the knob 41*a*. The switch body 41*b* is configured to output a signal when the knob 41*a* is pressed. Because the tact switch 41 is electrically connected to the processor 60, when the intermediate plate 13 contacts the tact switch 41, that is, when the intermediate plate 13 presses the knob 41*a* of the tact switch 41, the tact switch 41 transmits a signal to the processor 60. Therefore, when a signal is received from the tact switch 41, the processor 60 identifies that a human or animal detection signal is input.

The pressing member 15 is disposed on the bottom surface of the intermediate plate 13, and is formed so that when the intermediate plate 13 is depressed, the pressing member 15 moves downward integrally with the intermediate plate 13 and presses the knob 41*a* of the tact switch 41. Therefore, when a child enters the accommodation space 11 of the cabinet 10, the intermediate plate 13 is depressed by the weight of the child, so that the pressing member 15 provided on the bottom surface of the intermediate plate 13 presses the knob 41*a* of the tact switch 41.

The tact switch 41 may be fixed so as not to move below the intermediate plate 13. For example, because the clothes treating device 30 is provided below the intermediate plate 13, the tact switch 41 may be fixed to a case of the clothes treating device 30. However, when the tact switch 41 is fixed below the intermediate plate 13, the tact switch 41 may be damaged. For example, when a heavy object is placed on the intermediate plate 13, the depressing of the intermediate plate 13 becomes large, and in this case, the knob 41*a* of the tact switch 41 may be pressed beyond the specification so that the tact switch 41 may be damaged.

Therefore, in this embodiment, as illustrated in FIGS. 4 and 6, the tact switch 41 may be provided below the intermediate plate 13 so that the tact switch 41 may swing at a predetermined angle.

In detail, the tact switch 41 is provided in a support 43 which can swing at a predetermined angle. The support 43 is rotatably disposed in a fixed bracket 45. The fixed bracket 45 may be fixed to the case of the clothes treating device 30.

The support 43 is formed in a substantially rectangular flat plate shape. The tact switch 41 is disposed near one end of the support 43, and a rotating shaft 44 is provided at the other end thereof.

The fixed bracket 45 is formed in a substantially channel shape, and shaft holes 45*b* into which the rotating shaft 44 of the support 43 is inserted are formed at opposite sides 45*a* of the fixed bracket 45. Therefore, when the rotating shaft 44 is inserted into the shaft holes 45*b* of the fixed bracket 45, the support 43 may pivot at a predetermined angle with respect to the fixed bracket 45.

The support 43 may be elastically supported upward, that is, toward the intermediate plate 13 by an elastic member 46 so as to maintain a predetermined position.

In addition, in order to keep the position of the support 43 constant, the fixed bracket 45 may be provided with a stopper 47. In this embodiment, two stoppers 47 are provided in the fixed bracket 45. Because the stoppers 47 restrict the support 43 from being moved upward by the elastic member 46, the support 43 is positioned at a predetermined position from the intermediate plate 13. When the support 43 is positioned at the predetermined position from the intermediate plate 13, the gap G between the tact switch 41 and the pressing member 15 of the intermediate plate 13 is also maintained at a predetermined value as illustrated in FIG. 5.

In the case of this embodiment, as illustrated in FIG. 4, two torsion springs are used as the elastic member 46. Both ends of the rotating shaft 44 of the support 43 are inserted into the two torsion springs (i.e., elastic member 46), and the two torsion springs (i.e., elastic member 46) elastically support the support 43 in the upward direction. In this embodiment, the torsion springs are used as the elastic member 46; however, the elastic member 46 is not limited thereto. As another example, a coil spring may be provided below the support 43 to support the support 43 in the upward direction.

When the support 43 is elastically supported by the elastic member 46 in this manner, referring to FIG. 6, the support 43 may move downwardly by a predetermined angle θ about the rotating shaft 44. Therefore, when excessive weight is applied to the intermediate plate 13 and the intermediate plate 13 is depressed more than the design depression amount, the support 43 supporting the tact switch 41 is rotated downwardly so that the tact switch 41 is prevented from being damaged.

When a child enters the accommodation space 11 of the cabinet 10, the intermediate plate 13 is depressed by the weight of the child. Thus, referring to FIG. 7, the pressing member 15 provided in the intermediate plate 13 is moved downward to press the tact switch 41, that is, the knob 41*a* of the tact switch 41. When the knob 41*a* is pressed, the tact switch 41 outputs a human or animal detection signal to the processor 60.

When the weight of the child that has entered the cabinet 10 is the design weight, only the knob 41*a* of the tact switch 41 is moved downward by the pressing member 15 of the intermediate plate 13, and the support 43 keeps a horizontal state. However, when the weight of the child is more than the design weight, as illustrated in FIG. 7, the support 43 is pivoted downwardly by a certain angle about the rotating shaft 44 while the knob 41*a* of the tact switch 41 is pressed. Therefore, when the tact switch 41 is supported by the elastic member 46 to be rotated at a certain angle as in the present embodiment, the tact switch 41 may be prevented from being damaged by excessive depression of the intermediate plate 13.

On the other hand, in the above-described embodiment, the tact switch 41 is used to detect the depressing of the intermediate plate 13; however, the switch for detecting the depressing of the intermediate plate 13 is not limited thereto. As another example, a push switch or the like that can output a signal when pressed may be used instead of the tact switch 41.

The clothes manager 1 according to an embodiment of the disclosure may further include exhaust devices 51 and 52 configured to communicate the accommodation space of the cabinet 10, that is, the accommodation space 11 with the outside. The exhaust devices 51 and 52 are configured to open and close exhaust ports 21 and 12 under the control of the processor 60.

When the exhaust ports 21 and 12 are opened by the processor 60, the accommodation space 11 of the cabinet 10 communicates with the outside so that outside air may be introduced into the cabinet 10. Therefore, when a child enters the accommodation space 11 of the cabinet 10, the exhaust devices 51 and 52 open the exhaust ports 21 and 12, thereby preventing the child from asphyxiating.

In the case where the clothes manager 1 is normally operated, the processor 60 controls the exhaust devices 51 and 52 to close the exhaust ports 21 and 12, thereby blocking outside air from flowing into the accommodation space 11 of the cabinet 10.

As illustrated in FIG. 1, the exhaust devices 51 and 52 may be provided in the top surface of the cabinet 10 and the door 20. The first exhaust device 51 may be provided to open and close the first exhaust port 21 formed in the door 20, and the second exhaust device 52 may be provided to open and close the second exhaust port 12 formed in the top surface of the cabinet 10. The clothes manager 1 according to the this embodiment includes two exhaust devices 51 and 52, that is, the first exhaust device 51 and the second exhaust device 52; however, the number of the exhaust devices 51 and 52 is not limited thereto. Only one exhaust device 51 or 52 may be provided.

Figure 8:
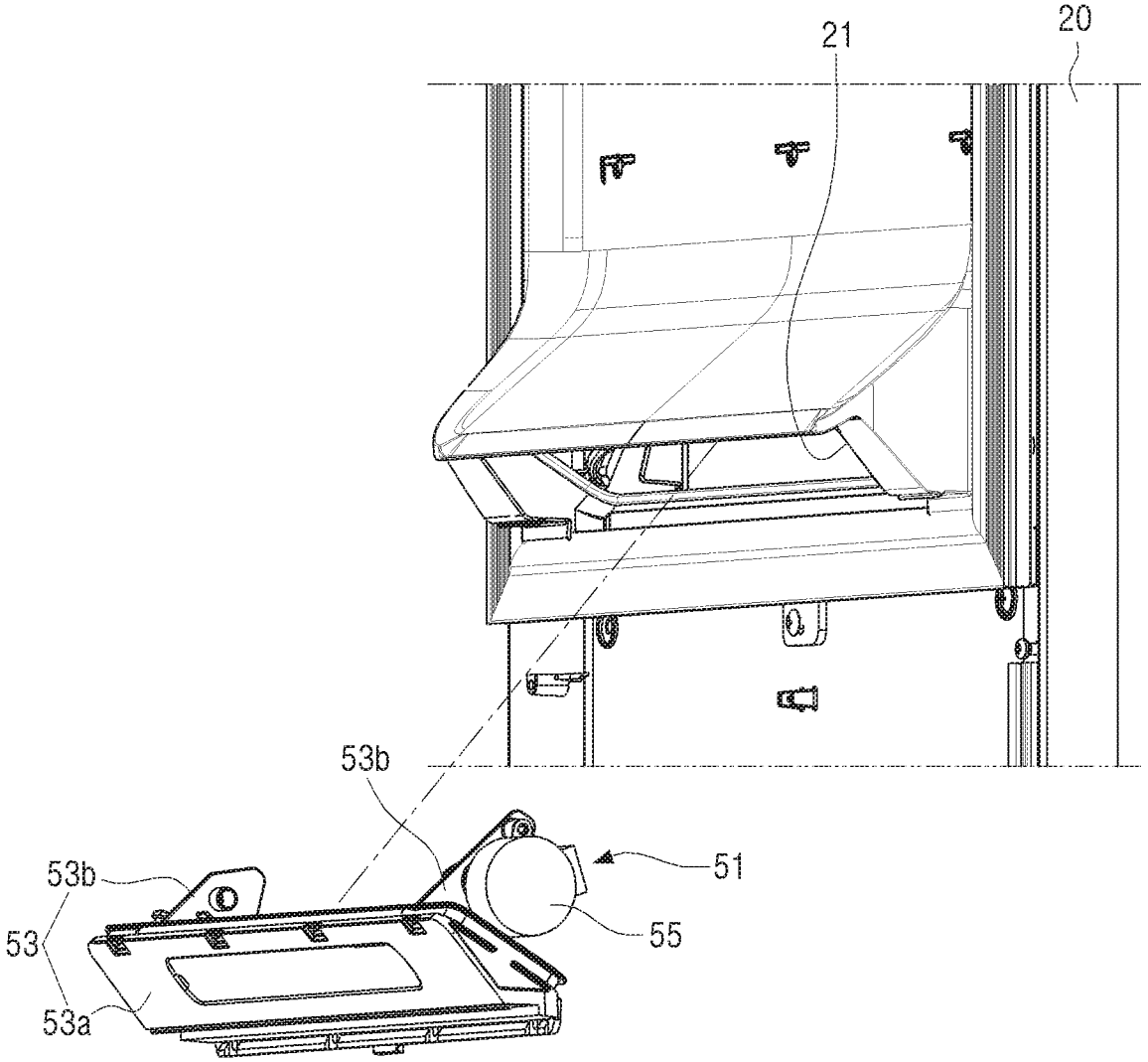
FIG. 8 is a partial perspective view illustrating an example of an exhaust device used in a clothes manager according to an embodiment of the disclosure.

FIG. 8 is a partial perspective view illustrating an example of an exhaust device provided in a door of a clothes manager according to an embodiment of the disclosure.

Referring to FIG. 8, the exhaust device 51 may include a blocking member 53 capable of blocking the exhaust port 21 and a motor 55 capable of turning the blocking member 53.

The exhaust port 21 is provided in the door 20 of the clothes manager 1, and is formed as an opening communicating with the outside. When an exhaust passage is provided in the door 20, the exhaust port 21 is formed to communicate with the exhaust passage.

The blocking member 53 is disposed in the door 20 so as to block or open the exhaust port 21. The blocking member 53 includes a blocking part 53*a*, which has a shape corresponding to the exhaust port 21 and is formed to block the exhaust port 21, and a pair of support arms 53*b* extending substantially vertically from both ends of the blocking part 53*a*. The pair of support arms 53*b* are rotatably disposed in the door 20.

The motor 55 is disposed on one side of the support arms 53*b* and is configured to rotate the support arms 53*b*. Therefore, when the processor 60 rotates the motor 55 in one direction, the pair of support arms 53*b* rotate with respect to the door 20, so that the blocking member 53 may open and close the exhaust port 21. In other words, in the case where the blocking member 53 is blocking the exhaust port 21, when the motor 55 rotates in one direction by a predetermined angle, the blocking member 53 is rotated to open the exhaust port 21. Thereafter, when the motor 55 is rotated by the predetermined angle in the opposite direction, the blocking member 53 is rotated in the opposite direction to block the exhaust port 21.

The exhaust device 52 disposed in the top surface of the cabinet 10 may be formed in the same structure as the exhaust device 51 as illustrated in FIG. 8. However, the exhaust device 52 is different in that it is provided to open and close the exhaust port 12 formed in the top surface of the cabinet 10. Therefore, a detailed description of the exhaust device 52 provided in the top surface of the cabinet 10 is omitted.

The processor 60 is configured to output an abnormal detection signal when a human or animal detection signal is received from the sensing device 40, for example, the tact switch 41. When the abnormal detection signal is output by the processor 60, the clothes manager 1 may output an abnormal detection alarm through a speaker or a display.

The processor 60 may treat the clothes stored in the accommodation space 11 of the cabinet 10 by controlling the clothes treating device 30. The processor 60 may include, for example, a processing circuit such as an electronic circuit board, various electronic components such as an application-specific integrated circuit (ASIC), a read-only memory (ROM), a random access memory (RAM), etc. and/or a program module. The processor 60 that treats the clothes by controlling the clothes treating device 30 is the same as or similar to the processor of the clothes manager; therefore, a detailed description of the configuration of the processor 60 is omitted.

The clothes manager 1 may include the speaker 81 or the buzzer 82 to output an abnormal detection alarm. In the case where the clothes manager 1 includes the speaker 81, the clothes manager 1 may be configured so that when the abnormal detection signal is output by the processor 60, the speaker 81 outputs an abnormal detection alarm message as a voice.

In addition, the clothes manager 1 may further include the transmitter 90 configured to transmit an abnormal detection signal to a mobile device such as a smartphone or an external device. When the mobile device or the external device receives the abnormal detection signal, they may output the abnormal detection alarm.

The transmitter 90 is configured to transmit information regarding a state of the clothes manager 1, for example, the abnormal detection signal, to the mobile device or the external device under the control of the processor 60.

The transmitter 90 may be connected to the mobile device or the external device by wireless or wired. For example, the transmitter 90 may be wired or wirelessly connected to a personal computer or the mobile device. The mobile device may include a notebook computer, a tablet computer, a smartphone, and the like. In this case, the abnormal detection signal generated by the processor 60 may be output to the mobile device or the external device through the transmitter 90.

When a program or an application for managing the clothes manager 1 is installed in the personal computer or the mobile device, the abnormal detection alarm may be provided to the user through communication or the internet. In addition, the user may obtain information about the state of the clothes manager 1 through the personal computer or the mobile device.

As another example, the transmitter 90 may be configured to be connected to a cloud or a web storage through the internet. In this case, the abnormal detection signal output from the processor 60 may be output to the cloud or the web storage.

In addition, as another example, the transmitter 90 may be configured to receive a signal from the mobile device or the external device and transmit the received signal to the processor 60 of the clothes manager 1. In other words, the transmitter 90 may be configured to transmit and receive signals with the mobile device and the external device. In this case, the transmitter 90 is implemented as a transceiver. When the transmitter 90 is implemented as the transceiver as described above, the user may control the clothes manager 1 through an application installed in the personal computer or the mobile device.

The clothes manager 1 may include a control panel 70 as a user interface for inputting a user's command. An example of the control panel 70 is illustrated in FIG. 9.

Figure 9:
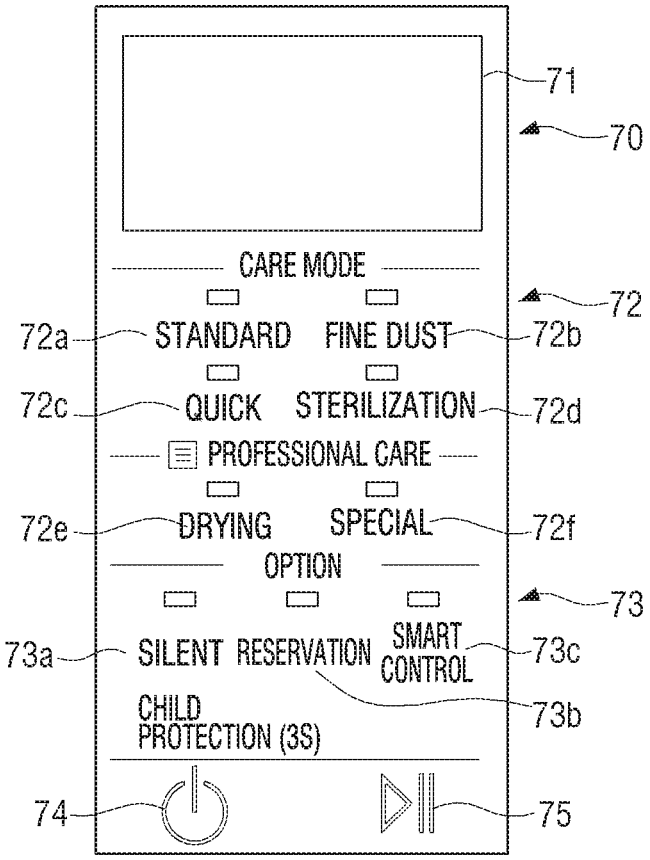
FIG. 9 is a view illustrating a control panel of a clothes manager according to an embodiment of the disclosure.

FIG. 9 is a view illustrating a control panel of a clothes manager according to an embodiment of the disclosure.

Referring to FIG. 9, the control panel 70 of the clothes manager 1 may include a display 71, a plurality of course selection buttons 72 configured to select a clothing treatment course, a plurality of option selection buttons 73 configured to perform special functions, a power button 74 and an operation button 75.

The display 71 is configured to display information necessary for the user to control the clothes manager 1, such as a selected clothing treatment course, the state of the clothes manager 1, an abnormal detection alarm, and the like. The display 71 may be implemented as a liquid crystal display (LCD) and the like capable of outputting such information.

The plurality of course selection buttons 72 may include a standard button 72*a* configured to select a standard course, a fine dust button 72*b* configured to select a course for removing fine dust, a quick button 72*c* configured to select a course for quickly performing clothing treatment, a sterilization button 72*d* configured to select a course for sterilize the clothes, a drying button 72*e* configured to select a course for drying the clothes, and a special button 72*f* configured to select a special course for performing a special treatment corresponding to the type of clothes or the like.

The plurality of course selection buttons 72 as illustrated in FIG. 9 are merely examples. When the clothes manager 1 is configured to perform other clothes treatment courses other than the above-described course, course selection buttons for selecting other clothes treatment courses may be provided.

The plurality of option selection buttons 73 may include a silent button 73*a*, a reservation button 73*b*, and a smart control button 73*c*.

The silent button 73*a* is a button for minimizing the operation noise of the clothes manager 1. In other words, when the silent button 73*a* is pressed, the clothes manager 1 operates to minimize noise when performing a selected clothing treatment course. Therefore, the silent button 73*a* may be pressed before one of the course selection buttons 72 mentioned above is pressed.

In addition, the silent button 73*a* may be configured to perform a function of operating the sensing device 40. In other words, the silent button 73*a* may perform a function of an operation button for turning on/off the operation of the sensing device 40. Accordingly, the silent button 73*a* may perform two functions, that is, a function of minimizing operation noise of the clothes manager 1 and a function of turning on/off the sensing device 40.

The time for pressing the silent button 73*a* may be set differently so that one of two functions can be selected. When the silent button 73*a* is pressed for a long time, for example, when the silent button 73*a* is pressed for 3 seconds, the sensing device 40 may be operated. When the silent button 73*a* is pressed for a short time, for example, when the silent button 73*a* is pressed for less than 3 seconds, the function of minimizing the operation noise of the clothes manager 1 which is a preset function of the silent button 73*a* is activated.

When the silent button 73*a* is pressed for 3 seconds or longer, a child protection mode in which the sensing device 40 operates is set. When a human or an animal (mainly a child) enters the accommodation space 11 of the cabinet 10 while the sensing device 40 is operating, the sensing device 40 detects this and transmits a human or animal detection signal to the processor 60. Here, the child protection mode refers to a protection mode that may prevent a human or an animal from asphyxiating even when the human or animal other than a child enters the cabinet 10.

When the silent button 73*a* is pressed again for 3 seconds or longer while the sensing device 40 is in operation, the operation of the sensing device 40 is released. In other words, the setting of the child protection mode is released. When the operation of the sensing device 40 is released, the sensing device 40 does not output a human or animal detection signal even when a child enters the accommodation space 11 of the cabinet 10.

The reservation button 73*b* is used when the user wants to reserve the clothing treatment course and the operating time of the clothes manager 1.

The smart control button 73*c* may be used to link the clothes manager 1 with a mobile device such as a smartphone. In other words, by using the smart control button 73*c*, the clothes manager 1 may be registered in an application installed in the smartphone, and the clothes manager 1 may be controlled using the smartphone.

In this embodiment, the silent button 73*a* is set as an operation button for operating the sensing device 40; however, the operation button for operating the sensing device 40 is not limited thereto. As another example, the reservation button 73*b* or the smart control button 73*c* may be set as the operation button of the sensing device 40, so that when the reservation button 73*b* or the smart control button 73*c* is pressed for 3 seconds or longer, the sensing device 40 is operated.

The power button 74 may turn on/off the clothes manager 1. In other words, when the power button 74 is pressed, power is applied to the clothes manager 1 so that the user may set an operating condition of the clothes manager 1 using the plurality of course selection buttons 72 and the plurality of option selection buttons 73. When the power button 74 is pressed again, the power supplied to the clothes manager 1 is turned off.

In addition, when the power button 74 is pressed while the sensing device 40 is operating, the child protection mode setting may be canceled and the sensing device 40 may be set not to operate.

The operation button 75 allows the clothes manager 1 to carry out the clothing treatment course. In other words, when the operation button 75 is pressed, the clothing treatment course selected by the user is performed. When the operation button 75 is pressed while the clothes manager 1 is in operation, the operation of the clothes manager 1 may be temporarily stopped.

In the above description, the control panel 70 is implemented with a plurality of buttons 72, 73, 74, and 75. Alternatively, the control panel 70 may be implemented as a touch screen. For example, the plurality of course selection buttons 72, the plurality of option selection buttons 73, the power button 74, and the operation button 75 may be implemented as software buttons displayed on the touch screen.

When a human or an animal (mainly a child) enters the clothes manager 1 according to an embodiment of the disclosure having the above-described structure, that is, when a human or an animal enters the accommodation space 11 of the cabinet 10, the sensing device 40 outputs a human or animal detection signal. When the human or animal detection signal is received from the sensing device 40 by the processor 60, the processor 60 may control the clothes manager 1 such that the human or animal is not asphyxiated.

Hereinafter, a method in which the processor 60 controls the clothes manager 1 when the child enters the accommodation space 11 of the cabinet 10 will be described with reference to FIGS. 10 and 11.

First, a method of controlling the clothes manager 1 when a child enters the accommodation space 11 of the cabinet 10 while the clothes manager 1 is normally performing the clothing treatment will be described.

Figure 10:
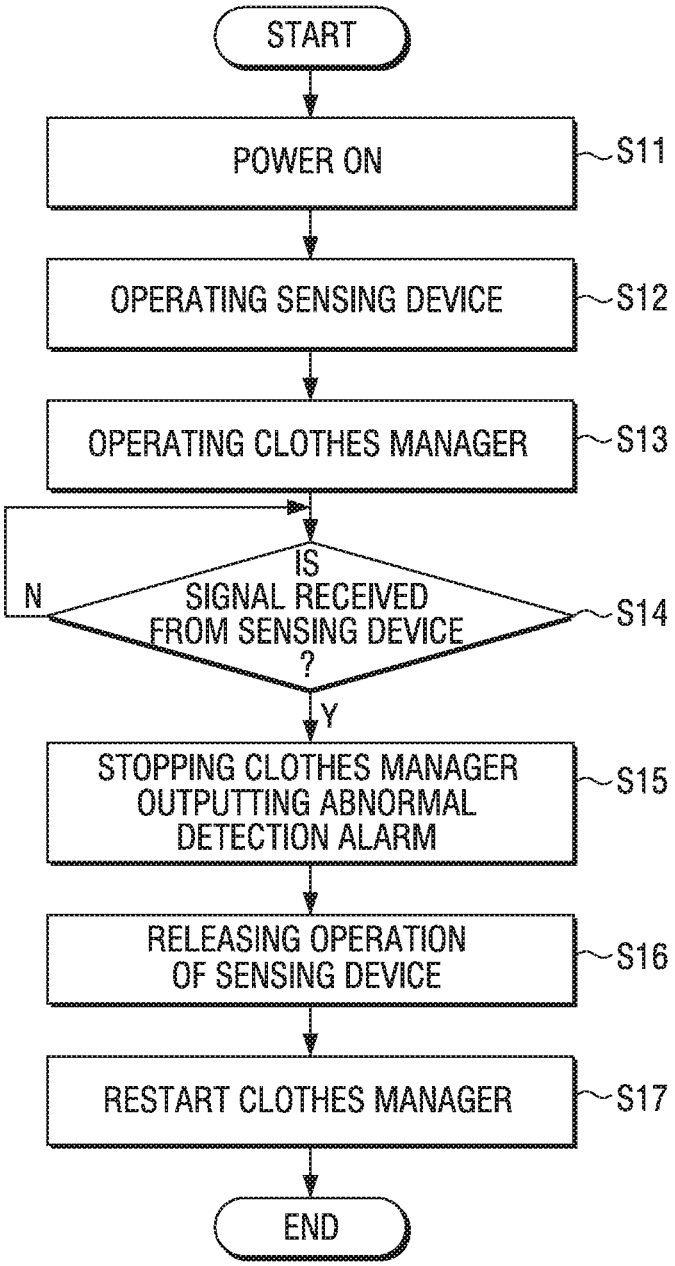
FIG. 10 is a flowchart illustrating a control method of a clothes manager according to an embodiment of the disclosure.

FIG. 10 is a flowchart illustrating a control method of a clothes manager according to an embodiment of the disclosure.

Referring to FIG. 10, the user turns on the power of the clothes manager 1. At this time, when the user presses the power button 74 of the control panel 70, the power is applied to the clothes manager 1 at operation S11.

Then, the user operates the sensing device 40 at operation S12. The sensing device 40 may be selectively operated by the user. In this embodiment, when the user presses the silent button 73*a* of the control panel 70 of FIG. 9 for 3 seconds or longer, the child protection mode in which the sensing device 40 operates is set.

Next, the user selects the clothing treatment course by using the plurality of course selection buttons 72 and the plurality of option selection buttons 73 of the control panel 70. Thereafter, the user presses the operation button 75 to operate the clothes manager 1 at operation S13.

While the clothes manager 1 is operating, the processor 60 identifies whether a signal is received from the sensing device 40 at operation S14.

When a child opens the door 20 of the cabinet 10 and enters the accommodation space 11 during the operation of the clothes manager 1, the sensing device 40 detects this and outputs a human or animal detection signal to the processor 60. In this embodiment, when the child has entered the cabinet 10, the intermediate plate 13 is depressed. When the intermediate plate 13 is depressed, the tact switch 41 is operated to output a signal to the processor 60.

When the signal is received from the sensing device 40, the processor 60 stops the operation of the clothes manager 1 and outputs an abnormal detection signal to allow the clothes manager 1 to output an abnormal detection alarm at operation S15. In the case where the clothes manager 1 includes the exhaust devices 51 and 52, the processor 60 controls the exhaust devices 51 and 52 to open the exhaust ports 21 and 12. Thus, because outside air flows into the accommodation space 11 of the cabinet 10 through the exhaust ports 21 and 12, the child may be prevented from asphyxiating even when the user opens the door 20 late.

When the abnormal detection alarm is output by the clothes manager 1, the user opens the door 20 of the clothes manager 1, checks the accommodation space 11 of the cabinet 10, and allows the child to leave the accommodation space 11.

Then, the user releases the operation of the sensing device 40 at operation S16. Thus, the abnormal detection alarm output from the clothes manager 1 is stopped. In this embodiment, the operation of the sensing device 40 is released when the silent button 73*a* is pressed for more than 3 seconds or when the power button 74 is pressed. At this time, when the exhaust devices 51 and 52 open the exhaust ports 21 and 12, the processor 60 controls the exhaust devices 51 and 52 to close the exhaust ports 21 and 12.

When the abnormal detection alarm is stopped, the user restarts the clothes manager 1 at operation S17. In this embodiment, when the user presses the operation button 75 of the control panel 70, the clothes manager 1 is restarted.

Next, a case in which a child enters the accommodation space 11 of the cabinet 10 when the clothes manager 1 is turned off will be described.

Figure 11:
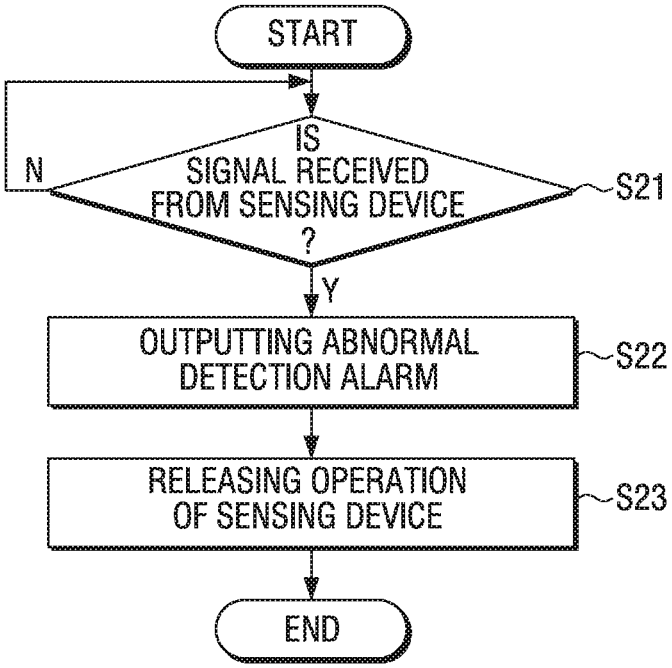
FIG. 11 is a flowchart illustrating a control method of a clothes manager capable of detecting a human or an animal when power of the clothes manager is turned off according to an embodiment of the disclosure.

FIG. 11 is a flowchart illustrating a control method of a clothes manager capable of sensing a human or an animal when power of the clothes manager is turned off according to an embodiment of the disclosure.

Referring to FIG. 11, in order to detect that the child enters the cabinet 10 while the clothes manager 1 is turned off, the sensing device 40 needs to be set to operate before the clothes manager 1 is turned off.

Therefore, before turning off the power of the clothes manager 1, the user presses the silent button 73*a* of the control panel 70 for 3 seconds or longer to set the child protection mode to operate the sensing device 40, and then turns off the power of the clothes manager 1. Thus, even when the power of the clothes manager 1 is turned off, the sensing device 40 is in the operating state.

The processor 60 identifies whether a signal is received from the sensing device 40 at operation S21. When a child opens the door 20 of the cabinet 10 and enters the accommodation space 11 while the clothes manager 1 is turned off, the sensing device 40 detects this and outputs a human or animal detection signal to the processor 60. In this embodiment, when the child enters the cabinet 10, the intermediate plate 13 is depressed. When the intermediate plate 13 is depressed, the tact switch 41 is operated to output a signal to the processor 60.

When the signal is received from the sensing device 40, the processor 60 outputs an abnormal detection signal to allow the clothes manager 1 to output an abnormal detection alarm at operation S22. In the case where the clothes manager 1 includes the exhaust devices 51 and 52, the processor 60 controls the exhaust devices 51 and 52 to open the exhaust ports 21 and 12. Thus, because outside air flows into the accommodation space 11 of the cabinet 10 through the exhaust ports 21 and 12, the child may be prevented from asphyxiating even when the user is delayed.

When the abnormal detection alarm is output by the clothes manager 1, the user opens the door 20 of the clothes manager 1, checks the accommodation space 11 of the cabinet 10, and allows the child to leave the accommodation space 11.

Then, the user releases the operation of the sensing device 40 at operation S23. Thus, the abnormal detection alarm output from the clothes manager 1 is stopped. In this embodiment, the operation of the sensing device 40 is released when the silent button 73*a* of the control panel 70 is pressed for more than 3 seconds or when the power button 74 is pressed.

As described above, in order to detect that the child enters the cabinet 10 even when the clothes manager 1 is turned off, the processor 60 and the sensing device 40 may be configured to receive the minimum power.

Hereinafter, when a child has entered the cabinet 10 of the clothes manager 1, an operation method of the clothes manager 1 having the control panel 70 of FIG. 9 will be described in detail with reference to FIG. 12.

FIGS. 12A, 12B, 12C, and 12D are views for explaining a method of operating a clothes manager using the control panel of FIG. 9 when a human or an animal enters the clothes manager during a power off mode according to various embodiments of the disclosure.

Figure 12A:
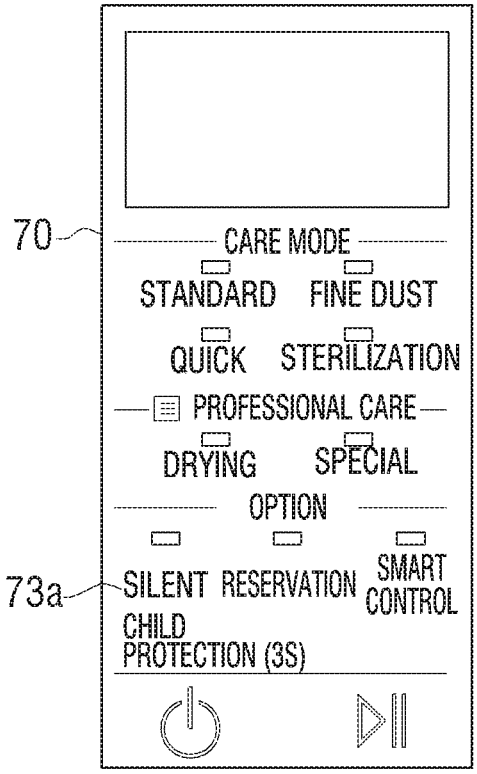
FIGS. 12A, 12B, 12C and 12D are views for explaining a method of operating a clothes manager using the control panel of FIG. 9 when a human or an animal enters the clothes manager during power off according to various embodiments of the disclosure.

Referring to FIG. 12A, a state of the control panel 70 when the power of the clothes manager 1 is turned off is illustrated. At this time, the sensing device 40 is in operation to protect the child. In other words, before turning off the power of the clothes manager 1, the user presses the silent button 73*a* for 3 seconds or longer to set the child protection mode in which the sensing device 40 operates. Even when the user turns off the power of the clothes manager 1 after operating the sensing device 40, the sensing device 40 operates as it is.

When the child enters the accommodation space 11 of the cabinet 10 and closes the door 20 while the clothes manager 1 is turned off, the sensing device 40 may detect this by depression of the intermediate plate 13. Thus, the sensing device 40 outputs a human or animal detection signal to the processor 60.

Then, the processor 60 outputs an abnormal detection signal to turn on the power of the control panel 70, and controls the clothes manager 1 to output the abnormal detection alarm in various ways.

Figure 12B:
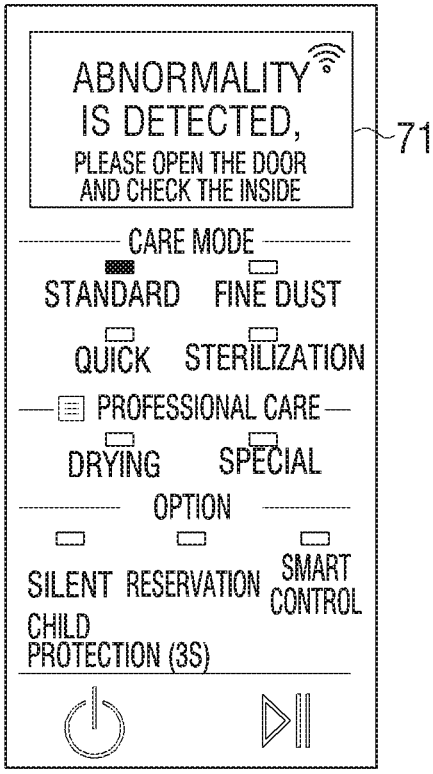

Referring to FIG. 12B, the processor 60 may control the control panel 70 to output a message such as 'Abnormality is detected, please open the door and check the inside' on the display 71 of the control panel 70.

Alternatively, the processor 60 may control the clothes manager 1 to output the above message by using the speaker 81. Alternatively, the processor 60 may generate an alarm sound through the buzzer 82.

Alternatively, when the clothes manager 1 is linked to a mobile device such as a smartphone, the processor 60 may transmit the abnormal detection signal to the user's mobile device through communication or the Internet, so that the application of the mobile device may output an abnormal detection alarm.

When the user recognizes the abnormal detection alarm output from the clothes manager 1, the user opens the door 20 of the clothes manager 1 and allows the child to come out.

Figure 12C:
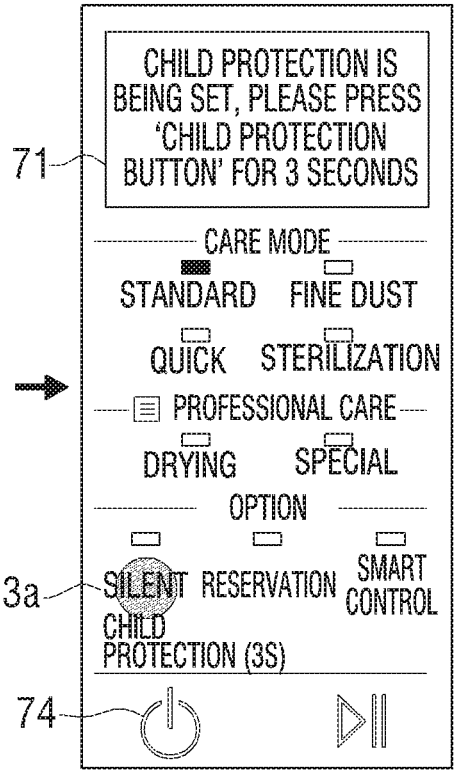

Referring to FIG. 12C, the processor 60 outputs a message of 'Child protection is being set, please press the child protection button for 3 seconds' on the display 71 of the control panel 70.

When the user presses the silent button (child protection button) 73*a* of the control panel 70 for 3 seconds or longer, the operation of the sensing device 40 is stopped to release the child protection setting. Thus, the abnormal detection alarm output by the clothes manager 1 is stopped.

Figure 12D:
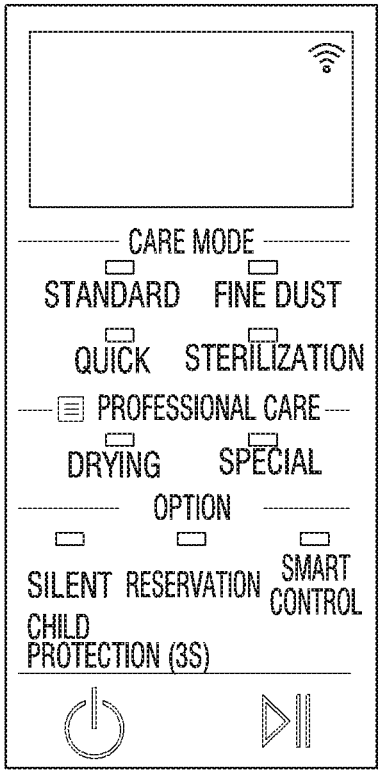

Referring to FIG. 12D, when the user stops the operation of the sensing device 40, the processor 60 turns off the power of the control panel 70 so that the clothes manager 1 returns to the power off state.

In the above description, the tact switch 41 disposed below the intermediate plate 13 is used as the sensing device 40. However, alternatively, the clothes manager 1 may be implemented so that the processor 60 identifies that the child has entered the accommodation space 11 of the cabinet 10 by using the opening and closing of the door 20 of the cabinet 10 without using the tact switch 41 and notifies this to the outside. In other words, a door sensor 23 (see FIG. 2) configured to detect the opening and closing of the door 20 may be used as the sensing device 40.

However, in the case that the door sensor 23 is used as the sensing device 40, when the power of the clothes manager 1 is turned off, the clothes manager 1 may not identify that the child has entered the cabinet 10. The clothes manager 1 may identify that the child has entered the cabinet 10 only when the clothes manager 1 is in operation.

Hereinafter, in the case of using the door sensor 23 as the sensing device 40, a control method of the clothes manager 1 will be described in detail with reference to FIG. 13.

FIGS. 13A, 13B, 13C, 13D, and 13E are views for explaining a method of operating a clothes manager using the control panel of FIG. 9 when a human or an animal enters the clothes manager while the clothes manager is in an operation mode according to various embodiments of the disclosure.

Figure 13A:
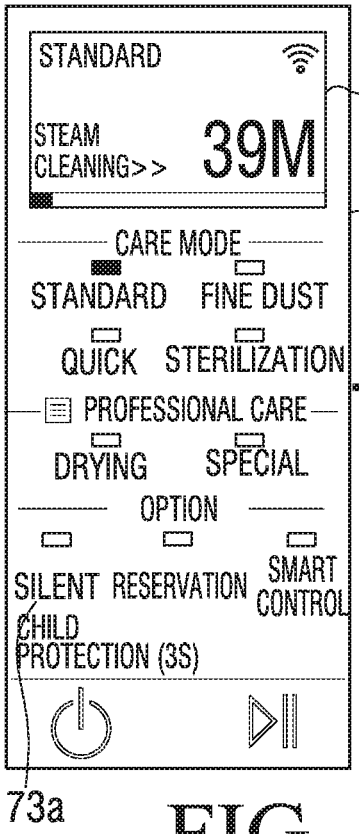
FIGS. 13A, 13B, 13C, 13D and 13E are views for explaining a method of operating a clothes manager using the control panel of FIG. 9 when a human or an animal enters the clothes manager while the clothes manager is in an operation mode according to various embodiments of the disclosure.

Referring to FIG. 13A, the state of the control panel 70 when the clothes manager 1 treats the clothes in the standard course is illustrated. At this time, the sensing device 40 is in operation to protect the child. In other words, before operating the clothes manager 1, the user presses the silent button 73*a* of the control panel 70 for 3 seconds or longer to set the child protection mode in which the sensing device 40 operates.

Figure 13B:
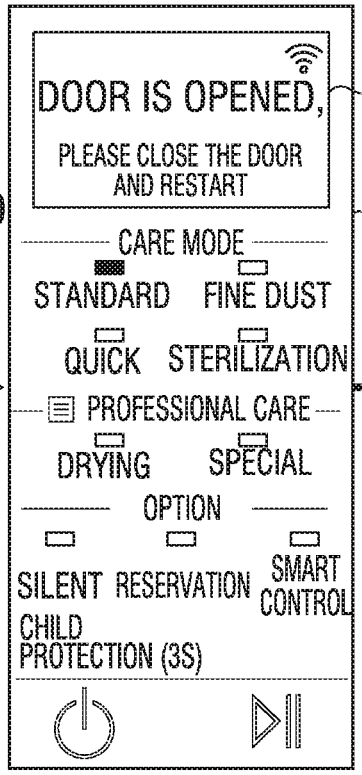

Referring to FIG. 13B, when a child opens the door 20 of the cabinet 10 during the normal operation of the clothes manager 1, the message of 'Door is opened, please close the door and restart' is displayed on the display 71 of the control panel 70. When the door is opened during the normal operation of the clothes manager 1, the door sensor 23 detects this and outputs a signal to the processor 60. Upon receiving the signal from the door sensor 23, the processor 60 stops the operation of the clothes manager 1.

Figure 13C:
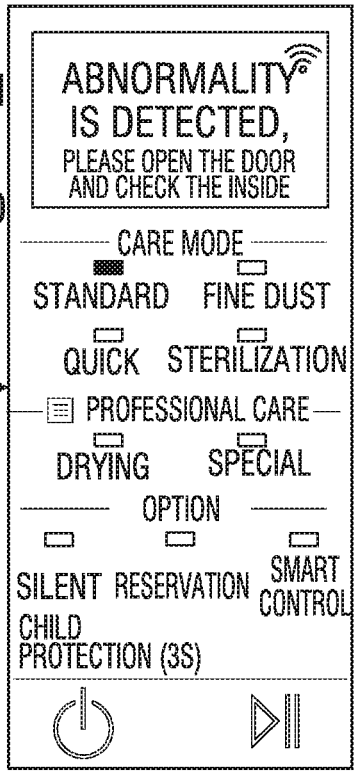

Referring to FIG. 13C, when the child enters the accommodation space 11 of the cabinet 10 and closes the door 20, the processor 60 identifies an abnormality and outputs an abnormal detection signal. In this case, the processor 60 may identify that the door is opened from the closed state and then closed based on the signal output from the door sensor 23. In other words, when the processor 60 identifies that the door 20 is opened and closed during the operation of the clothes manager 1, the processor 60 identifies that an abnormality has occurred and outputs an abnormal detection signal, so that the clothes manager 1 outputs an abnormal detection alarm. For example, the processor 60 controls the display 71 of the control panel 70 so that a message such as 'Abnormality is detected, pleased open the door and check the inside' is displayed on the display 71.

In addition, the processor 60 may control the clothes manager 1 to output the abnormal detection alarm in various ways.

For example, the processor 60 may output the above-described message as a voice using the speaker 81. Alternatively, the processor 60 may generate an alarm sound through the buzzer 82.

Alternatively, when the clothes manager 1 is linked to a mobile device such as a smartphone, the processor 60 may transmit the abnormal detection signal to the user's mobile device through communication or the Internet, so that the application of the mobile device may output an abnormal detection alarm.

When the user recognizes the abnormal detection alarm output from the clothes manager 1, the user opens the door 20 of the clothes manager 1 and allows the child to come out.

Figure 13D:
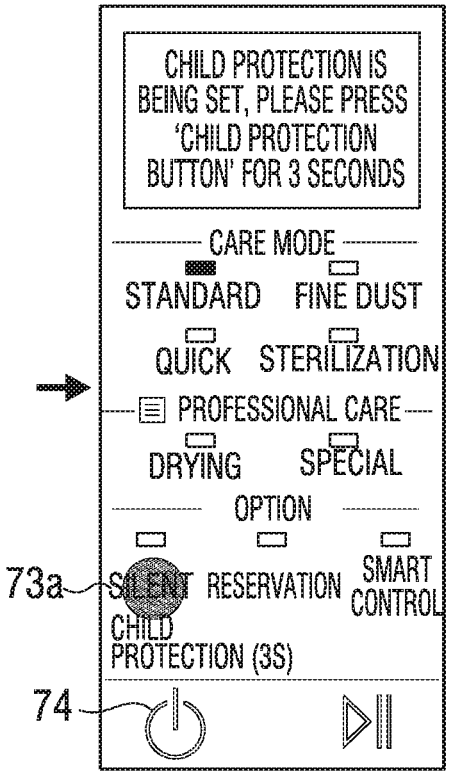

Referring to FIG. 13D, the processor 60 outputs a message of 'Child protection is being set, please press the child protection button for 3 seconds' on the display 71 of the control panel 70.

When the user presses the silent button 73*a* of the control panel 70 for 3 seconds or longer, the operation of the sensing device 40 is stopped so that the child protection setting is released. Thus, the abnormal detection alarm output by the clothes manager 1 is stopped.

Figure 13E:
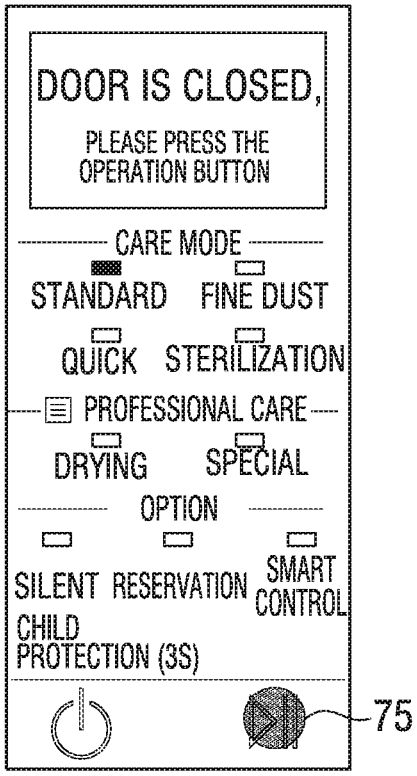

Referring to FIG. 13E, when the user stops the operation of the sensing device 40, the processor 60 outputs a message of 'Door is closed, please press the operation button' on the display 71 of the control panel 70.

Accordingly, when the user presses the operation button 75 of the control panel 70, the clothes manager 1 re-executes the clothing treatment course that has been stopped.

As described above, in the clothes manager 1 according to an embodiment of the disclosure, the child protection mode may be set by using the door sensor 23 capable of detecting the opening and closing of the door 20 as the sensing device 40.

In the clothes manager 1 according to an embodiment of the disclosure, the child protection mode is not set unless the silent button 73*a* is pressed for a long time (for example, 3 seconds). Therefore, when there is no child at home, the child protection mode may not be set. Thus, even when the door 20 is opened and closed during the operation of the clothes manager 1, the abnormal detection alarm does not occur.

In the above description, the door sensor 23 for detecting opening and closing of the door 20 of the cabinet 10 is used to detect that a human or an animal (mainly a child) enters the accommodation space 11 of the cabinet 10 of the clothes manager 1.

However, a sensor for detecting that a human or an animal has entered the accommodation space 11 of the cabinet 10 is not limited thereto. Various sensors may be used as long as they can detect that a human or an animal enters the accommodation space 11 of the cabinet 10.

When a human or an animal enters the accommodation space 11 of the cabinet 10 of the clothes manager 1, the state of the accommodation space 11 changes. Therefore, it is possible to detect whether a human or an animal enters the cabinet 10 of the clothes manager 1 by using a sensor capable of detecting a change in space.

For example, an image sensor 100 capable of detect the presence of a human or an animal by using an image of a human or an animal such as a camera may be used.

Figure 14:
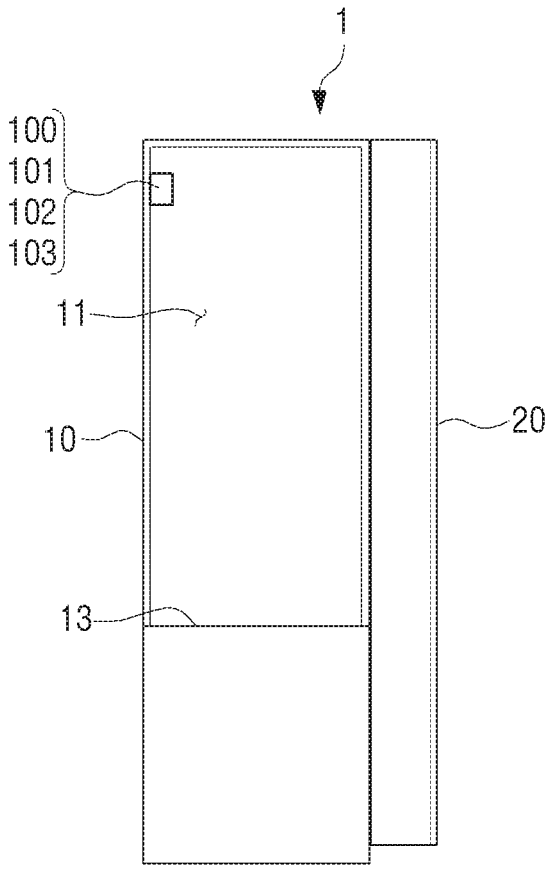
FIG. 14 is a view illustrating a clothes manager according to another embodiment of the disclosure.

FIG. 14 is a view illustrating a clothes manager according to another embodiment of the disclosure.

Referring to FIG. 14, the image sensor 100 may be disposed at an upper portion of the accommodation space 11 of the cabinet 10 of the clothes manager 1. The image sensor 100 may be disposed at a position where the image sensor 100 can photograph a face of a human or an animal entering the accommodation space 11 of the cabinet 10.

When the image sensor 100 is used as the sensing device, it is possible to accurately identify whether something entered the accommodation space 11 of the cabinet 10 is a human or an animal Therefore, when the user puts an object on the intermediate plate 13 of the cabinet 10, the processor 60 may identify that no human or animal has entered by using the image sensor 100, and may not output an abnormal detection alarm.

As another example, when a human or an animal enters the accommodation space 11 of the cabinet 10, the concentration of carbon dioxide ($CO_2$) in the accommodation space 11 increases. Therefore, the sensing device may be configured to identify whether a human or an animal enters the accommodation space 11 of the cabinet 10 by detecting the concentration of the carbon dioxide. In other words, a carbon dioxide ($CO_2$) sensor 101 capable of measuring a change in the concentration of carbon dioxide in the accommodation space 11 of the cabinet 10 may be used as the sensing device.

The carbon dioxide sensor 101 may be disposed at any position of the accommodation space 11 of the cabinet 10. However, the carbon dioxide sensor 101 may be disposed in the upper portion of the accommodation space 11 of the cabinet 10 as illustrated in FIG. 14. When the carbon dioxide sensor 101 is used as the sensing device, it is possible to accurately identify whether a human or an animal has entered the accommodation space 11 of the cabinet 10.

As another example, a motion detection sensor (for example, passive infrared (PIR) sensor) 102 capable of detecting a motion of a human or an animal entering the accommodation space 11 of the cabinet 10 may be used as the sensing device.

Because the motion detection sensor 102 detects a motion of a human or an animal, the motion detection sensor 102 may be disposed in the upper portion of the accommodation space 11 of the cabinet 10 as illustrated in FIG. 14.

As another example, when a human or an animal enters the accommodation space 11 of the cabinet 10, the temperature of the accommodation space 11 increases. Therefore, a temperature sensor 103 for detecting the temperature may be used as the sensing device.

As the temperature sensor 103, a thermopile capable of detecting radiant heat may be used. Because warm air rises upward, the temperature sensor 103 may be disposed in the upper portion of the accommodation space 11 of the cabinet 10 as illustrated in FIG. 14.

As another example, by detecting the displacement of the intermediate plate 13 of the clothes manager 1 due to the weight of a human or an animal as described above, the clothes manager 1 may be configured to identify whether a human or an animal has entered the accommodation space 11 of the cabinet 10. In other words, a displacement detection sensor capable of detecting displacement of the intermediate plate 13 may be used as the sensing device.

Figure 15:
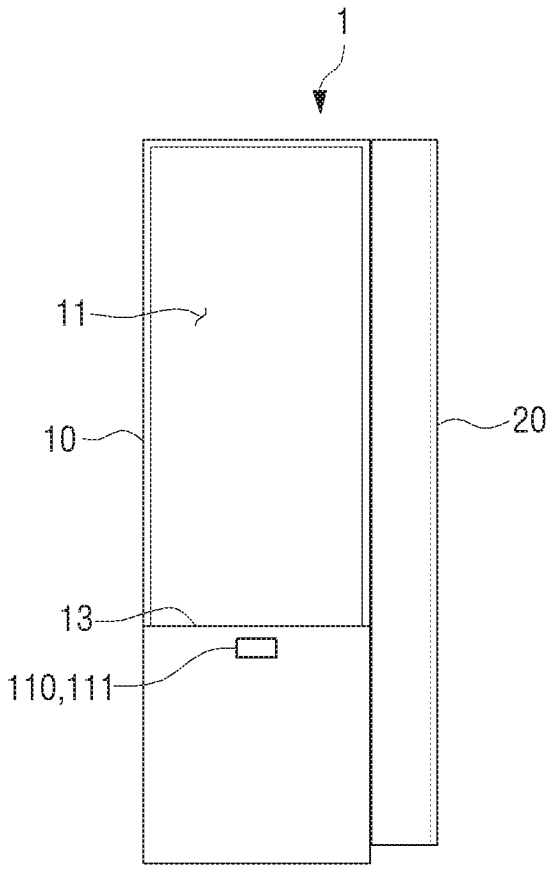
FIG. 15 is a view illustrating a clothes manager according to another embodiment of the disclosure.

FIG. 15 is a view illustrating a clothes manager according to another embodiment of the disclosure.

Referring to FIG. 15, a permanent magnet may be disposed on the bottom surface of the intermediate plate 13 of the clothes manager 1, and a Tunneling Magneto Resistance (TMR) sensor 110 may be disposed to be spaced a predetermined distance below the permanent magnet. Thus, when a human or an animal enters the accommodation space 11 of the cabinet 10 and the intermediate plate 13 is depressed, the TMR sensor 110 may detect the displacement of the intermediate plate 13, and then transmit a signal to the processor 60. Therefore, the processor 60 may identify that a human or an animal has entered the cabinet 10 based on the signal output from the TMR sensor 110.

As another example, a linear variable differential transformer (LVDT) sensor 111 capable of detecting a displacement of the intermediate plate 13 may be used as the sensing device. Because the LVDT sensor 111 detects the displacement of the intermediate plate 13, the LVDT sensor 111 may be disposed below the intermediate plate 13 of the clothes manager 1 as illustrated in FIG. 15. Therefore, the processor 60 may identify that a human or an animal has entered the cabinet 10 based on a signal output from the LVDT sensor 111.

Figure 16:
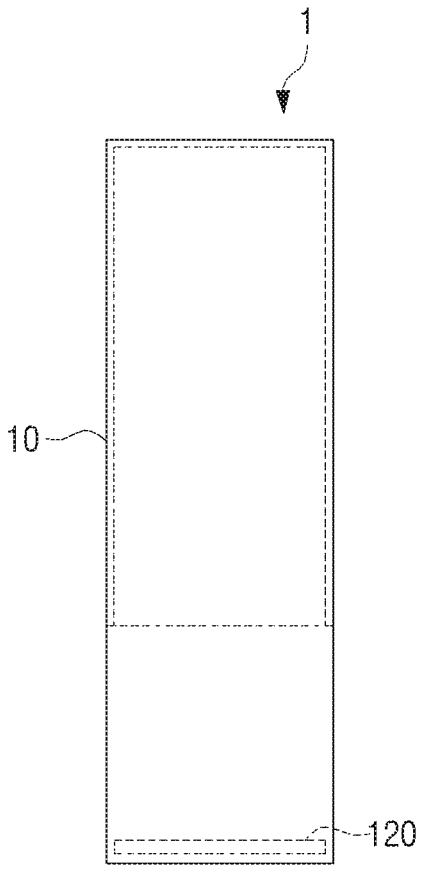
FIG. 16 is a view illustrating a clothes manager according to another embodiment of the disclosure.

FIG. 16 is a view illustrating a clothes manager according to another embodiment of the disclosure.

Referring to FIG. 16, as another example, when a human or an animal enters the accommodation space 11 of the cabinet 10, the weight of the clothes manager 1 increases by the weight of the human or animal. The clothes manager 1 may be configured to identify whether a human or an animal has entered the cabinet 10 by measuring the change in weight of the clothes manager 1 using a load cell 120.

In this case, the load cell 120 may be disposed in the lower portion of the clothes manager 1 as illustrated in FIG. 16 so as to detect a change in the weight of the clothes manager 1.

With the clothes manager according to an embodiment of the disclosure having the above structure, the clothes manager may notify the user by detecting that a human or an animal has entered the accommodation space of the cabinet, thereby preventing the human an animal from asphyxiating in the accommodation space of the cabinet.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A clothes treatment apparatus comprising:

a cabinet including an accommodation space in which clothes are accommodated;

a door configured to open and close an opening of the cabinet;

a clothes treating device configured to treat the clothes accommodated in the accommodation space of the cabinet;

a sensing device configured to detect that a human or an animal has entered the cabinet; and a processor configured to output an abnormal detection signal based on a human or animal detection signal being transmitted by the sensing device, wherein the sensing device comprises an intermediate plate forming a bottom of the accommodation space of the cabinet and being formed to be deformed depending on the weight of an object placed on the intermediate plate, and wherein the sensing device identifies whether the human or an animal has entered the cabinet by detecting a depressing of the intermediate plate.

2. The clothes treatment apparatus of claim 1, wherein the sensing device comprises:

a tact switch disposed below the intermediate plate and configured to transmit a signal to the processor when the intermediate plate is in contact with the tact switch.

3. The clothes treatment apparatus of claim 2, wherein the tact switch is configured to swing at a predetermined angle.

4. The clothes treatment apparatus of claim 3, wherein the sensing device further comprises:

a fixed bracket fixed to a case of the clothes treating device;

a support rotatably disposed in the fixed bracket and configured to support the tact switch; and an elastic member configured to elastically support the support.

5. The clothes treatment apparatus of claim 1, wherein the cabinet includes an exhaust device, and wherein when the human or animal detection signal is received from the sensing device, the processor is further configured to operate the exhaust device to open the accommodation space of the cabinet to an outside environment.

6. The clothes treatment apparatus of claim 5, wherein the exhaust device comprises a first exhaust device provided in the door and a second exhaust device provided in an upper portion of the cabinet.

7. The clothes treatment apparatus of claim 1, wherein the sensing device is disposed inside the cabinet and includes any one of an image sensor, a carbon dioxide sensor, a motion detection sensor, or a temperature sensor configured to identify the human or the animal.

8. The clothes treatment apparatus of claim 1, wherein the sensing device comprises:

a displacement detection sensor configured to detect a displacement of the intermediate plate.

9. The clothes treatment apparatus of claim 1, wherein the sensing device is disposed in a lower portion of the clothes treatment apparatus and includes a load cell configured to detect a weight change of the clothes treatment apparatus.

10. The clothes treatment apparatus of claim 1, wherein the sensing device includes a door sensor configured to output a signal when the door is opened, and wherein when the signal is received from the door sensor while the clothes treating device is in operation, the processor is further configured to:

stop the operation of the clothes treating device, and output the abnormal detection signal.

11. The clothes treatment apparatus of claim 1, wherein the processor is further configured to transmit the abnormal detection signal output to a mobile device.

12. The clothes treatment apparatus of claim 1, further comprising:

a control panel configured to receive a user command, wherein the control panel comprises an operation button configured to turn on or off the sensing device.

13. The clothes treatment apparatus of claim 12, wherein, when the operation button is pressed shorter than a predetermined time, a function preset to the operation button is performed, and wherein, when the operation button is pressed longer than the predetermined time, a child protection mode in which the sensing device operates is set.

14. The clothes treatment apparatus of claim 13, wherein, when the operation button is pressed longer than the predetermined time while the sensing device is in operation, the operation of the sensing device is released.

15. The clothes treatment apparatus of claim 13, wherein the control panel comprises a power button, and wherein when the power button is turned off, the operation of the sensing device is released.

16. A control method of a clothes treatment apparatus comprising a cabinet, a clothes treating device, a sensing device, an intermediate plate and a processor, the control method comprising:

pressing an operation button of the sensing device to operate the sensing device;

identifying, by the sensing device, whether a human or animal has entered the cabinet by detecting a depressing of the intermediate plate forming a bottom of an accommodation space of the cabinet;

generating an abnormal detection alarm based on an abnormal detection signal output by the processor based on a human or animal detection signal being received from the sensing device; and stopping an operation of the sensing device and releasing the abnormal detection alarm when the operation button is pressed again or when a power button is pressed.

17. The control method of claim 16, wherein the sensing device is configured to operate when the clothes treatment apparatus is turned off.

18. The control method of claim 17, wherein the sensing device comprises:

a tact switch disposed below the intermediate plate, the tact switch transmitting a signal to the processor when the intermediate plate is in contact with the tact switch.

19. The control method of claim 16, further comprising, when the human or animal detection signal is received from the sensing device while the clothes treatment apparatus is in operation, stopping an operation of the clothes treatment apparatus.

20. The control method of claim 16, further comprising, when a door of the clothes treatment apparatus is opened and closed while the clothes treatment apparatus is in operation, stopping an operation of the clothes treatment apparatus.

21. A clothes treatment apparatus comprising:

a cabinet including an accommodation space in which clothes are accommodated;

a door configured to open and close an opening of the cabinet;

a clothes treating device configured to treat the clothes accommodated in the accommodation space of the cabinet;

a sensing device configured to detect that a human has entered the cabinet; and a processor configured to control the clothes treatment apparatus based on a detection signal being transmitted by the sensing device, wherein the sensing device comprises an intermediate plate at a bottom of the accommodation space of the cabinet, the intermediate plate being configured to change physical form depending on the weight of an object placed on the intermediate plate, and wherein the sensing device identifies whether a human has entered the cabinet by detecting a depressing of the intermediate plate.

* * * * *